US006706380B2

(12) United States Patent
Edwards et al.

(10) Patent No.: US 6,706,380 B2
(45) **Date of Patent: *Mar. 16, 2004**

(54) SMALL CROSS-SECTION COMPOSITES OF LONGITUDINALLY ORIENTED FIBERS AND A THERMOPLASTIC RESIN AS CONCRETE REINFORCEMENT

(75) Inventors: Christopher M. Edwards, Midland, MI (US); Edward L. D'Hooghe, Hulst (NL)

(73) Assignee: Dow Global Technologies Inc., Midland, MI (US)

( * ) Notice: Subject to any disclaimer, the term of this patent is extended or adjusted under 35 U.S.C. 154(b) by 28 days.

This patent is subject to a terminal disclaimer.

(21) Appl. No.: 09/756,449

(22) Filed: Jan. 8, 2001

(65) Prior Publication Data

US 2001/0049399 A1 Dec. 6, 2001

Related U.S. Application Data

(60) Provisional application No. 60/175,894, filed on Jan. 13, 2000.

(51) Int. Cl.[7] ..... D04H 1/00; D04H 13/00; D04H 3/00; D04H 5/00; B32B 27/12; B32B 18/00; B32B 27/02; B32B 27/04; B32B 15/02; B32B 19/00; B32B 21/02; B32B 23/02; D02G 3/00

(52) U.S. Cl. ..... 428/292.1; 428/297.4; 428/299.1; 428/299.4; 428/299.7; 428/364; 428/375; 428/399; 428/401; 428/403

(58) Field of Search ..... 428/299.4, 299.7, 428/296.7, 295.4, 297.4, 298.1, 114, 292.1, 357, 364, 370, 374, 375, 399, 403

(56) References Cited

U.S. PATENT DOCUMENTS

| | | | | | |
|---|---|---|---|---|---|
| 3,470,051 | A | * | 9/1969 | Meyer | 156/171 |
| 3,742,106 | A | * | 6/1973 | Price | 264/131 |
| 3,993,726 | A | * | 11/1976 | Moyer | 264/174 |
| 4,194,873 | A | | 3/1980 | Killmeyer | 425/93 |
| 4,312,917 | A | * | 1/1982 | Hawley | 428/375 |
| 4,341,835 | A | | 7/1982 | MacDowell | 428/292 |
| 4,376,834 | A | | 3/1983 | Goldwasser et al. | 521/159 |
| 4,379,870 | A | | 4/1983 | Matsumoto | 523/221 |
| 4,439,387 | A | * | 3/1984 | Hawley | 264/108 |
| 4,559,262 | A | | 12/1985 | Cogswell et al. | 428/294 |
| 4,648,224 | A | | 3/1987 | Kitta et al. | 52/223 |
| 4,706,430 | A | | 11/1987 | Sugita et al. | 52/309 |
| 4,713,283 | A | * | 12/1987 | Cogswell et al. | 428/240 |
| 5,182,064 | A | | 1/1993 | Ishizuka et al. | 264/137 |
| 5,362,542 | A | | 11/1994 | Ozawa et al. | 428/70 |
| 5,433,419 | A | | 7/1995 | Murakami | 264/136 |
| 5,580,642 | A | | 12/1996 | Okamoto et al. | 428/212 |
| 5,725,954 | A | * | 3/1998 | Montsinger | 428/397 |
| 5,763,042 | A | | 6/1998 | Kaiser et al. | 428/108 |
| 5,763,043 | A | | 6/1998 | Porter et al. | 428/109 |
| 5,798,067 | A | * | 8/1998 | Long, Sr. | 264/134 |
| 5,891,560 | A | | 4/1999 | Edwards et al. | 428/295 |

(List continued on next page.)

FOREIGN PATENT DOCUMENTS

| | | |
|---|---|---|
| DE | 3336765 | 7/1984 |
| EP | 0774552 | 5/1997 |
| EP | 0994223 | 4/2000 |
| FR | 2009094 | 1/1970 |
| WO | 89/00493 | 1/1989 |
| WO | 96/16792 | 6/1996 |
| WO | 98/31891 | 7/1998 |

*Primary Examiner*—Cynthia H. Kelly
*Assistant Examiner*—Camie S Thompson

(57) ABSTRACT

Small cross-section composites are used as reinforcements for concrete. The composites include longitudinally oriented fibers embedded in a depolymerizable and repolymerizable thermoplastic matrix. The composites are mixed into the wet concrete and poured with the concrete to form a reinforced concrete structure.

6 Claims, 1 Drawing Sheet

U.S. PATENT DOCUMENTS 5,894,003 A 4/1999 Lockwood ..... 264/36.19
5,989,713 A 11/1999 Naaman ..... 428/397
6,060,163 A 5/2000 Naaman ..... 428/397
6,346,325 B1 * 2/2002 Edwards et al. ..... 428/401

* cited by examiner

SMALL CROSS-SECTION COMPOSITES OF LONGITUDINALLY ORIENTED FIBERS AND A THERMOPLASTIC RESIN AS CONCRETE REINFORCEMENT

CROSS-REFERENCE STATEMENT

This application claims the benefit of U.S. Provisional Application No. 60/175,894, filed on, Jan. 13, 2000.

STATEMENT REGARDING FEDERALLY SPONSORED RESEARCH OR DEVELOPMENT

The research and development leading to the subject matter disclosed herein was not federally sponsored.

BACKGROUND OF THE INVENTION

This invention relates to reinforcing materials for concrete and concrete structures so reinforced.

Concrete is one of the most common building materials. It is used in a wide variety of structures such as bridges, walls, floors, building supports, roadways, and runways among many others.

For several reasons, concrete structures are usually made with some sort of reinforcement. Concrete is often prone to cracking as the structure is weathered or subjected to bending loads and impact. This is mainly due to the poor tensile properties of the concrete. Reinforcing materials are commonly used to improve the tensile properties of concrete structures. In addition, concrete is applied wet and in some instances must hold its position shape (against, e.g. the force of gravity) until it hardens. Sometimes reinforcing materials are added to the concrete to help hold the mass together and in position until it sets.

Concrete reinforcements come in several types. Reinforcing bars are common. These are typically steel but are sometimes a thermoset/fiber composite. A second type of reinforcement is an overwrap. The overwrap is commonly a thermoset/fiber composite that is applied to the outside of a structure. Overwraps of this sort are often used to shore up a cracked or damaged structure, or to strengthen structures so they become more resistant to natural phenomena such as hurricanes, tornadoes and earthquakes. Overwraps are not limited to concrete structures—they can be applied to structures of many types of construction, such as brick, stone, and frame constructions.

A third type of concrete reinforcement is fibers that are embedded in the concrete. The fibers used in this application are usually steel or polypropylene. These fibers are short, commonly of the order of 12–50 mm in length, and typically have a diameter of around 0.1–1 mm. The fibers are mixed into the wet concrete. When the concrete is poured, the fibers become randomly oriented in the concrete, forming a "fuzzy" matrix that helps prevent cracking or crack propagation. This matrix also helps hold the wet concrete together until it can harden.

The common steel and polypropylene fibers each have significant limitations. Steel fibers are very strong and stiff, but they are difficult to handle and apply. They are prone to corrosion when exposed to water and salts. Polypropylene fibers do not corrode, but are undesirably ductile and not as strong as desired. Further, with all fibers but especially strong stiff fibers such as steel, it is relatively difficult to generate the full strength of the fibers since they do not bond adequately to the concrete so that when a load is applied, they tend to pull out below their ultimate failure strength.

Glass fibers would have an excellent combination of stiffness, strength and resistance to corrosion, but they are too brittle for this application. The process of mixing glass fibers into the concrete and pouring the concrete breaks the fibers up into short lengths that do not provide much reinforcement. In addition, glass fibers are not chemically stable in the alkaline environment of concrete.

In order to overcome the deficiencies of glass fibers, it has been attempted to provide them with a polymeric coating. The polymeric coating would be expected to reduce the friability of the glass fibers as well as protect them from the alkalinity of the concrete. However, it is difficult and expensive to provide glass fibers with a suitably thin coating that also completely covers the fibers.

Thus, it would be desirable to provide an improved method by which reinforcement can be provided to concrete, which provides high strength and stiffness combined with ease of handling, no corrosion and excellent mechanical and/or chemical bonding into the concrete.

SUMMARY OF THE INVENTION

In one aspect, this invention is a composite adapted for use in a concrete structure, the composite comprising a plurality of longitudinally oriented fibers embedded in a matrix of a depolymerizable and repolymerizable thermoplastic resin, said composite having a longest cross-sectional dimension of not more than about 5 mm and an aspect ratio of at least 10.

In a second aspect, this invention is a concrete structure reinforced with up to 10 volume-percent of a small cross-section composite, said small cross-section composite comprising a plurality of longitudinally oriented reinforcing fibers embedded in a matrix of a depolymerizable and repolymerizable thermoplastic resin, said small cross-section composite having a longest cross-sectional dimension of not more than about 5 mm and an aspect ratio of at least 10.

In a third aspect, this invention is a method of making a reinforced concrete structure, comprising the steps of (a) forming a wet concrete mix containing a mortar or cement, a particulate filler and up to 10 volume-percent of a small cross-section composite, said small cross-section composite comprising a plurality of longitudinally oriented fibers embedded in a matrix of a depolymerizable and repolymerizable thermoplastic resin, said small cross-section composite having a longest cross-sectional dimension of not more than about 5 mm and an aspect ratio of at least 10, (b) shaping the concrete and (c) permitting the concrete to cure.

DETAILED DESCRIPTION OF THE INVENTION

The small cross-section, composite of this invention comprises a composite of longitudinally oriented fibers embedded in a matrix of a thermoplastic resin. It is conveniently made in a pultrusion process as described in U.S. Pat. No. 5,891,560 to Edwards et al. By "small cross-section", it is meant that the small cross-section composite has a longest cross-sectional dimension of no greater than about 5 mm.

The small cross-section composite advantageously has a longest cross-sectional dimension of up to 5 mm, preferably of up to about 2.5 mm. It has an aspect ratio of at least 10, preferably at least 25, more preferably at least 40. The small cross-section composite can have any convenient cross-sectional shape, including circular, elliptical, oval, semicircular, rectangular, square, or any other regular or irregular polygon shape.

A typical small cross-section composite has a width of from about 0.2 to about 5 mm, preferably about 0.5 to about 2 mm, and a thickness of 0.1 to about 1 mm. A suitable length is from about 10 to about 100 mm, preferably about 15 to about 75, more preferably 25 to about 60 mm.

Figure 1:
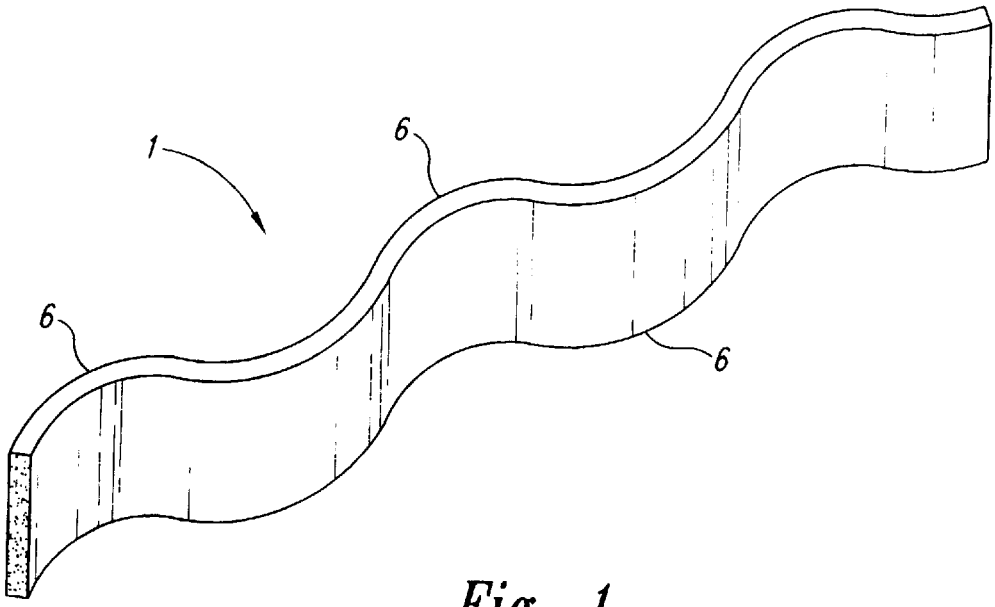
FIGS. 1 and 2 are isometric views of embodiments of the invention.
Figure 2:
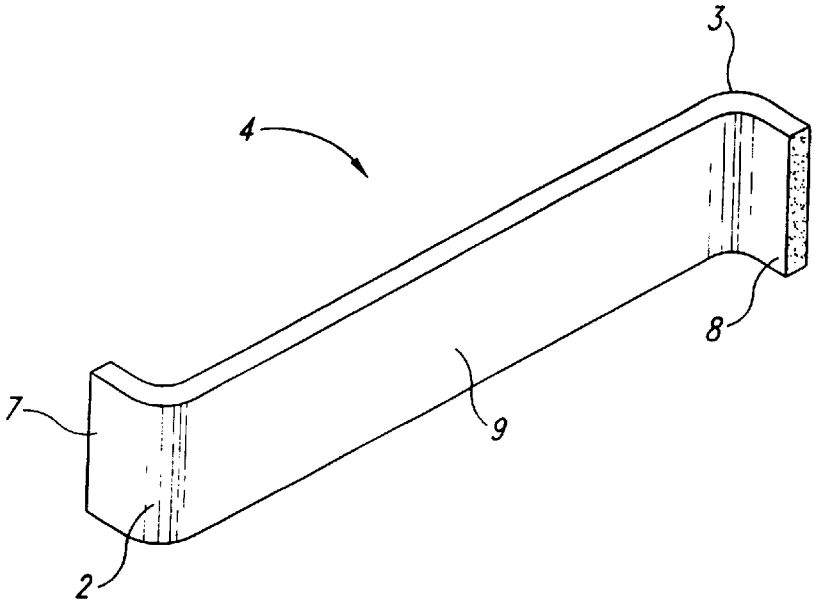

The small cross-section composite preferably has some curvature or bending that provides sites for interlocking with the cured concrete. The curvature can take the form, e.g., of a sinusoidal curve or wave throughout the length of the small cross-section composite, or can take the form of one or more, preferably at least two, localized curves or bends. FIGS. 1 and 2 illustrate exemplary ways how this curvature or bending can appear. In FIG. 1, small cross-section composite 1 is generally flat but has sinusoidal curve 6 running throughout its length. In FIG. 2, small cross-section composite 4 has terminal curves 2 and 3, forming terminal sections 7 and 8 that are angled with respect to the plane of the main portion 9 of the small cross-section composite. Another way to provide for mechanical keying into the concrete is to form a spiraled composite having any non-circular cross-section. This effect can be obtained by pultruding any cross-sectional shape except a circle, and either twisting the pultruded mass after it exits the die or rotating the die during the pultrusion process.

The fiber can be any strong, stiff fiber that is capable of being processed into a composite through a pultrusion process and bonds well to the thermoplastic resin. Suitable fibers are well known and are commercially available. Glass, other ceramics such as SiC, boron, $B_4C$, $Al_2O_3$, MgO and $Si_3N_4$, carbon, metal or high melting polymeric (such as aramid) fibers are suitable. Mixtures of different types of fibers can be used. Moreover, fibers of different types can be layered or interwoven within the composite in order to optimize certain desired properties. For example, glass fibers can be used in the interior regions of the small cross-section composite and more expensive fibers such as carbon fibers used in the exterior regions. This permits one to obtain the benefits of the high stiffness of the carbon fibers while reducing the overall fiber cost. In addition, the exterior carbon fibers provide additional protection of the glass fibers from the alkaline environment in the cement.

Glass is a preferred fiber due to its low cost, high strength and good stiffness.

Suitable fibers are well known and commercially available. Fibers having diameters in the range of about 10 to 50 microns, preferably about 15–25 microns, are particularly suitable.

The fibers are longitudinally oriented in the small cross-section composite. By "longitudinally oriented", it is meant that the fibers extend essentially continuously throughout the entire length of the small cross-section composite, and are aligned in the direction of pultrusion.

As it is the fibers that mainly provide the desired reinforcing properties, the fiber content of the small cross-section composite is preferably as high as can conveniently be made. The upper limit on fiber content is limited only by the ability of the thermoplastic resin to wet out the fibers and adhere them together to form an integral composite without significant void spaces. The fibers advantageously constitute at least 30 volume percent of the small cross-section composite, preferably at least 50 volume percent and more preferably at least 65 volume percent.

The depolymerizable and repolymerizable thermoplastic resin (DRTP) can be any that can be adapted for use in a pultrusion process to form the composite and which does not undesirably react with the fibers. However, the DRTP resin preferably has additional characteristics. The DRTP resin preferably is a rigid polymer having a $T_g$ of not less than 50° C. In addition, the DRTP resin preferably forms a low viscosity melt during the pultrusion process, so as to facilitate wetting out the fibers. The DRTP resin preferably does not react with concrete in an undesirable way and is substantially inert to (i.e., does not react with, absorb, dissolve or significantly swell when exposed to) water and common salts.

A particularly suitable DRTP is a rigid thermoplastic polyurethane or polyurea (both referred to herein as "TPUs"). TPUs have the property of partially depolymerizing when heated due in part to the presence of residual polymerization catalyst. The catalyst is typically hydrolytically- and thermally stable and is "live" in the sense that it is not inactivated once the TPU has been polymerized. This depolymerization allows the TPU to exhibit a particularly low melt viscosity, which enhances wet-out of the fibers. Upon cooling, the polyurethane repolymerizes to again form a high molecular weight polymer.

In addition, TPUs tend to form particularly strong adhesive bonds to concrete.

Suitable thermoplastic polyurethanes are described, for example, in U.S. Pat. No. 4,376,834 to Goldwasser et al. Composites that can be adapted for use in the invention and which are made using such rigid TPUs are described in U.S. Pat. No. 5,891,560 to Edwards et al.

The composites described in U.S. Pat. No. 5,891,560 include a continuous phase which is advantageously a polyurethane or polyurea (or corresponding thiourethane or thiourea) impregnated with at least 30 percent by volume of fibers that extend through the length of the composite. The general pultrusion process described in U.S. Pat. No. 5,891,560 includes the steps of pulling a fiber bundle through a preheat station, a fiber pretension unit, an impregnation unit, a consolidation unit that includes a die which shapes the composite to its finished shape, and a cooling die. The pulling is advantageously accomplished using a haul off apparatus, such as a caterpillar-type haul off machine. Additional shaping or post-forming processes can be added as needed.

As described in U.S. Pat. No. 5,891,560, the preferred continuous phase polymer is a thermoplastic polyurethane or polyurea made by reacting approximately stoichiometric amounts of (a) a polyisocyanate that preferably has two isocyanate groups per molecule, (b) a chain extender, and optionally (c) a high equivalent weight (i.e., above 700 to about 4000 equivalent weight) material containing two or more isocyanate-reactive groups. By "chain extender", it is meant a compound having two isocyanate-reactive groups per molecule and a molecular weight of up to about 500, preferably up to about 200. Suitable isocyanate-reactive groups include hydroxyl, thiol, primary amine and secondary amine groups, with hydroxyl, primary and secondary amine groups being preferred and hydroxyl groups being particularly preferred.

Preferred TPUs are rigid, having a glass transition temperature ($T_g$) of at least 50° C. and a hard segment content (defined as the proportion of the weight of the TPU that is made up of chain extender and polyisocyanate residues) of at least 75 percent. Rigid thermoplastic polyurethanes are commercially available under the trade name ISOPLAST® engineering thermoplastic polyurethanes. ISOPLAST is a registered trademark of The Dow Chemical Company.

"Soft" polyurethanes having a $T_g$ of 25° C. or less can be used, but tend to form a more flexible composite. Thus, "soft" polyurethanes are preferably used as a blend with a rigid thermoplastic polyurethane. The "soft" polyurethane is generally used in a proportion sufficient to increase the elongation of the composite (in the direction of the orientation of the fibers). This purpose is generally achieved when the "soft" polyurethane constitutes 50 percent or less by weight of the blend, preferably 25 percent or less.

The preferred DRTP can be blended with minor amounts (i.e., 50 percent by weight or less) of other thermoplastics, such as polystyrene, polyvinyl chloride, ethylene vinyl acetate, ethylene vinyl alcohol, polybutylene terephthalate, polyethylene terephthalate, acrylonitrile-styrene-acrylic, ABS (acrylonitrile-butadiene-styrene), polycarbonate, polypropylene and aramid resins. If necessary, compatibilizers can be included in the blend to prevent the polymers from phase separating.

The small cross-section composite of this invention is conveniently prepared by pultruding a thin sheet of composite and, in a subsequent step, cutting the sheet in the direction of the fibers to the desired width to form small cross-section strips. These strips are then cut to the desired length. Of course, the order of cutting can be reversed. The preferred curvature can be imparted to the small cross-section composite on-line, preferably before cutting the sheet down. Less preferably, this can be done in a subsequent operation.

To introduce curves, the impregnated fiber bundle exiting the consolidation unit is conveniently fed through a subsequent moving die that forms a curved or crimped form into the part. A caterpillar-type die having matched dies that act on the profile to form the curves, as described in U.S. Pat. No. 5,798,067 to Long, is suitable. Alternatively, a pair of oscillating matched dies can be used to produce a similarly curved profile. Because the matrix resin is a thermoplastic, the introduction of curves using either of these methods can also be done off-line, i.e., separate from the pultrusion process.

Curves or bends of the type illustrated in FIG. 2 can also be introduced in a post-forming process, by reheating the composite to a temperature at which the DRTP softens, forming the softened composite into the desired shape, and then cooling. Again, this is preferably done before the sheet is cut down.

The small cross-section composite of the invention is conveniently used in the same manner as are conventional steel or polypropylene fibers. The small cross-section composite is blended into the wet concrete, either before or after the dry cement or mortar is mixed with water, and mixed to disperse the small cross-section composite throughout the mix. As used herein, "concrete" is used in the usual sense of meaning a mixture of a particulate filler such as gravel, pebbles, sand, stone, slag or cinders in either mortar or cement. Suitable cements include hydraulic cements such as Portland cement, and aluminous cement. The cement or concrete may contain other ingredients such as, for example, plastic latex, hydration aids, curatives, and the like. In addition to the small cross-section composite, other fibers can be included, such as polymeric one-component fibers, bi-component fibers, carbon fibers, ceramic fibers, glass fibers and wood fibers.

The concrete containing the dispersed small cross-section composite is then shaped in any convenient manner (such as pouring or the so-called shotcrete process) and allowed to cure to form the concrete structure. A large variety of concrete structures can be made in accordance with the invention, including road surfaces, aircraft runways, walls, building walls and floors, foundations, retaining walls, culverts, tunnels, pillars, and the like. Of course, the small cross-section composite of the invention can be used in conjunction with other types of reinforcements, such as rebars, overwraps and the like.

The small cross-section composite will generally constitute up to 10 volume percent of the concrete mixture, preferably from about 0.1 to about 10 volume percent and more preferably from about 0.5 to 2 volume-percent.

The resulting concrete structure contains the small cross-section composite embedded within the concrete. The individual pieces of small cross-section composite are advantageously oriented randomly within the concrete, thereby producing omnidirectional reinforcement. In addition, the small cross-section composite helps to hold the wet concrete in place until it has had time to cure, in much the same way as conventional fibers do.

The preferred TPU matrix provides the further advantage of adhering well to the concrete, thus increasing effectiveness of the small cross-section composite. Moreover, in the preferred embodiments where the small cross-section composite is adapted to mechanically bond to the concrete, even greater effectiveness is achieved.

An important aspect of the invention is that it permits the use of glass fibers as reinforcing materials for concrete. The thermoplastic matrix of the small cross-section composite helps overcome the problem of brittleness that is associated with plain glass fibers. This permits the small cross-section composite to withstand the mixing and pouring processes without significant breakage. In addition, it is believed that the thermoplastic resin matrix isolates the glass from the alkaline environment of the cement, slowing or preventing the chemical deterioration of the glass.

What is claimed is:

1. A reinforced concrete structure comprising a composite having a plurality of longitudinally oriented fibers embedded in a matrix of a depolymerizable and repolymerizable rigid thermoplastic polyurethane resin, having a glass transition temperature ($T_g$) of at least 50° C. and a hard segment content (defined as the proportion of the weight of the TPU that is made up of chain extender and polyisocyanate residues) of at least 75 percent, the composite having a longest cross-sectional dimension of not more than 5 mm and an aspect ratio of at least 10, which composite is embedded in concrete so as to reinforce the concrete.

2. The reinforced concrete structure of claim 1, in which the depolymerizable and repolymerizable polyurethane is blended with a minor amount of a polystyrene, polyvinyl chloride, ethylene vinyl acetate, ethylene vinyl alcohol, polybutylene terephthalate, polyethylene terephthalate, acrylonitrile-styrene-acrylic, ABS (acrylonitrile-butadiene-styrene), polycarbonate, polypropylene or aramid resin.

3. The reinforced concrete structure of claim 1, wherein the fibers are glass, ceramic, carbon, metal or polymeric fibers.

4. The reinforced concrete structure of claim 3, wherein the fibers include glass fibers.

5. A reinforced concrete structure comprising a composite having a plurality of longitudinally oriented fibers embedded in a matrix of a rigid engineering thermoplastic polyurethane resin, which composite has a longest cross-sectional dimension of 1 to 3 mm and an aspect ratio of at least 25 and which composite is embedded in concrete so as to reinforce the concrete.

6. The reinforced concrete structure of claim 5 comprising a composite which has an aspect ratio of at least 40 and a length of 25–75 mm.

* * * * *